US011746632B2

(12) United States Patent
Scott

(10) Patent No.: US 11,746,632 B2
(45) Date of Patent: Sep. 5, 2023

(54) METHOD FOR FRACKING OPERATIONS UTILIZING A MULTI-PRESSURE FRACKING ADAPTER

(71) Applicant: Michael D. Scott, Oklahoma City, OK (US)

(72) Inventor: Michael D. Scott, Oklahoma City, OK (US)

( * ) Notice: Subject to any disclaimer, the term of this patent is extended or adjusted under 35 U.S.C. 154(b) by 0 days.

(21) Appl. No.: 17/089,918

(22) Filed: Nov. 5, 2020

(65) Prior Publication Data

US 2021/0215027 A1 Jul. 15, 2021

Related U.S. Application Data

(60) Provisional application No. 62/961,485, filed on Jan. 15, 2020.

(51) Int. Cl.

| | |
|---|---|
| ***E21B 43/26*** | (2006.01) |
| ***E21B 47/117*** | (2012.01) |
| ***E21B 34/02*** | (2006.01) |
| ***E21B 33/06*** | (2006.01) |
| ***E21B 33/03*** | (2006.01) |

(52) U.S. Cl.

CPC ..... *E21B 43/2607* (2020.05); *E21B 33/03* (2013.01); *E21B 33/06* (2013.01); *E21B 34/02* (2013.01); *E21B 47/117* (2020.05)

(58) Field of Classification Search

CPC ..... E21B 43/26; E21B 34/02; E21B 33/02; E21B 33/03; E21B 33/038; E21B 33/04

See application file for complete search history.

(56) References Cited

U.S. PATENT DOCUMENTS

| | | | | |
|---|---|---|---|---|
| 3,965,987 | A | 6/1976 | Biffle | |
| 4,823,882 | A | 4/1989 | Stokley et al. | |
| 5,743,335 | A | 4/1998 | Bussear | |
| 6,360,822 | B1 | 3/2002 | Robertson | |
| 7,140,445 | B2 | 11/2006 | Shahin et al. | |
| 7,311,148 | B2 | 12/2007 | Giroux et al. | |
| 8,327,943 | B2 * | 12/2012 | Borak | E21B 33/037 166/368 |
| 8,950,485 | B2 * | 2/2015 | Wilkins | E21B 43/26 166/281 |

* cited by examiner

*Primary Examiner* — Tara Schimpf

(74) *Attorney, Agent, or Firm* — Edward L. White; Edward L. White P.C.

(57) ABSTRACT

An improved method for fracking operations, the improvement comprising measuring the last piece of casing, cutting the casing to the measured length, installing a suspension device on the last piece of casing, landing the suspension device inside the well-head, installing pack-off bushing around the suspension device, engaging locking pins to maintain the pack-off bushing's position, removing blowout preventer, installing a two-way check valve into the mandrel, attaching a multiple pressure rated fracking adapter rated up to twice the pressure rating of the well-head casing, testing the sealing elements of the fracking adapter to insure proper sealing, attaching a fracking valve assembly to the fracking adapter, where an operator fracks a hydrocarbon well for enhanced production without compromising safety by eliminating potential leak points and reducing the costs and time required for preparing and conducting fracking operations and returning the well to production.

11 Claims, 4 Drawing Sheets

METHOD FOR FRACKING OPERATIONS UTILIZING A MULTI-PRESSURE FRACKING ADAPTER

CROSS-REFERENCE TO RELATED APPLICATIONS

Applicants claim benefit pursuant to 35 U.S.C. § 119 and hereby incorporate by reference a provisional patent application for "An improved method for fracking operations utilizing a multi-pressure fracking adapter," Application 62/961,485, filed Jan. 15, 2020. Applicants hereby incorporate by reference a non-provisional patent application for "Integrated Double-Studded Pack-Off Adapter," application Ser. No. 16/575,536, filed Sep. 19, 2019.

FIELD OF THE INVENTION

The invention generally relates to oil and gas well enhanced recovery operations through hydraulic fracturing. In particular, the invention relates to a method that reduces time and cost needed for fracking operations by eliminating the replacement of the lower pressure wellhead system with a higher pressure wellhead system to match the pressure rating of the higher-pressure fracking valve assembly by installing an Integrated Double-Studded Pack-Off Adapter to conduct fracking operations.

BACKGROUND

In completing wells or to increase hydrocarbon flow in existing wells, hydraulic fracturing known as "fracking" may be used to accomplish well stimulation, fracking is a well-known well stimulation technique where the rock in the producing formation is fractured by a pressurized liquid. The process involves the high-pressure injection of fracking fluid into a wellbore to create cracks in the producing formations through which hydrocarbons will flow more freely. When the hydraulic pressure is removed from the well, small grains of hydraulic fracturing proppants hold the fractures open thus increasing the flow.

During normal drilling operations, a lower pressure wellhead casing is normally installed, and the well is completed. If no enhanced recovery is required, then the lower pressure wellhead system remains in place for receiving the production valve assembly. However, if the operator of the well determines there is a need for enhanced recovery to increase the flow of hydrocarbons, the operator may employ fracking to enhance the flow hydrocarbons. For fracking operations to occur, the current industry method requires that a fracking valve assembly, similar to a production valve assembly, be installed on the wellhead after the production valve assembly is removed. The fracking valve assembly will receive the fracking fluids at pressure into the well for enhanced recovery. The fracking valve assembly differs from the production valve assembly in that it operates at higher pressures, which requires higher pressure rated equipment.

A typical lower-pressure wellhead system may be rated at 5,000 pounds per square inch ("psi") ("5k"). Fracking operations normally requires an operator to use a higher pressure rated fracking valve assembly for fracking the well. For example, the operator may use a 15,000 psi ("15k") fracking valve assembly for fracking the well where the fracking valve assembly pressure rating is three times that of the typical lower-pressure wellhead casing. Currently, fracking operations require the operator remove the lower-pressure wellhead system from the well and replace it with a matching 15 k pressure rated wellhead system to engage the 15 k pressure rated fracking valve assembly to prevent a potential safety issues that may be caused by a dissimilar pressure rated equipment. For a lower pressure well, such as a 10,000 psi ("10k"), may only require the tubing head to be switched to a higher-pressure tubing head for fracking operations. Upon the completion of the fracking operations, the operator removes the higher pressure rated wellhead system and replaces it with lower-pressure wellhead system for production. The current method requires multiple steps during the removal and replacement process to ensure the safety of personnel and then environment including but not limited to pressure testing after the installation of a wellhead casing.

The current fracking method causes the operator to incur several costs and/or delays 1) the operator needs either to buy or rent the high-pressure oilfield equipment for the duration of the fracking operations, which may be unpredictable as to the time required, 2) availability of the high-pressure oilfield equipment, 3) the operator must discontinue production of hydrocarbons while the lower-pressure wellhead casing is switched out with the higher-pressure wellhead casing and switched back and the associated manpower cost to switch the wellhead casings and 4) potential safety issues caused by the changing of the wellhead casings.

SUMMARY OF THE INVENTION

The present invention overcomes these shortcomings by providing an improved method that eliminates the need to use a higher-pressure wellhead system to match the fracking valve assembly for fracking operations by installing a multi-pressure fracking adapter between the lower pressure wellhead system and the higher-pressure fracking valve assembly. This method eliminates the need to purchase or rent high-pressure oilfield equipment and eliminates the high-pressure oilfield equipment availability problem, where an operator may not be able to conduct fracking operations until the equipment is available. The improved method allows the operator to retain the production wellhead system whether the well is in its initial production phase or whether the well is being reworked to enhance production. Additionally, the downtime and manpower costs are greatly reduced since the time needed to install and remove the multi-pressure fracking adapter is much less.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention.

Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE DRAWINGS

FIG. 3 is a front view of a wellhead configured with an Integrated Double-Studded Pack-Off Adapter and fracking wellhead assembly for fracking operations.

DETAILED DESCRIPTION OF THE INVENTION

The improved method for fracking operations preferably a multi-pressure fracking adapter. The improved method provides improved safety through 1) less welding in the field, 2) allowing running annular seals through the blow-out preventer, 3) eliminating a tubing head with potentially multiple leak points and pin failures, 4) providing the ability to set a back pressure valve and two-way check valve during fracking operations, 5) reducing the height of the fracking valve assembly and 6) allowing seal testing and monitoring. Additionally, the improved method saves time by 1) eliminating the changing of the casing head assembly to match the pressure rating of the fracking valve assembly, 2) reducing the amount of handling and testing of the blow-out preventer, and 3) eliminating the "wait-on-cement" time. The improved method provides cost savings by 1) eliminating the need to purchase the high-pressure rated wellhead components, 2) eliminating the need to rent equipment previously required for fracking operations, and 3) eliminating the need to wait for cement to set and cure before continuing operations.

Figure 1:
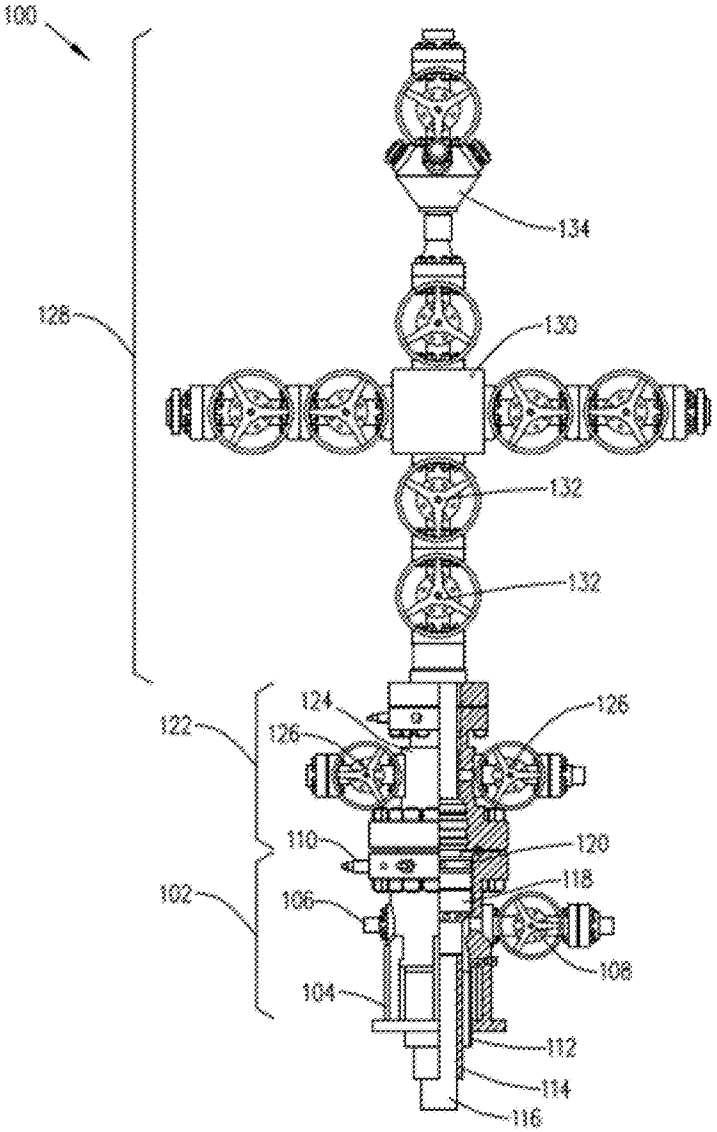
FIG. 1 is a front view of a wellhead configured with a fracking wellhead assembly for fracking operations.

FIG. 1 is a front view of a wellhead assembly 100 configured for fracking operations. The wellhead assembly 100 may comprise a casing head assembly 102, a casing spool assembly 122, and a fracking valve assembly 128.

The casing head assembly 102 further comprises a casing head 104, an annulus output 106, and an annulus output valve 108. An operator drills a wellbore to a desired depth and then the operator places a surface casing 112 into the wellbore to ensure that no hydrocarbons seeps out of the wellbore as they are brought to the surface, and to prevent other fluid or gases from seeping into the formation through the well. The surface casing 112 extends from the wellbore into the casing head 104 where the surface casing 112 may be rigidly affixed to the casing head 104 by welding. One skilled in the art may also threadedly affix the casing head 104 to the surface casing 112. A casing string 114 may reside inside the surface casing 112 and may be rigidly or removably affixed to the casing head 104. The operator may insert production tubing 116 into the casing string 114 and suspend the production tubing 116 within the casing head 104 by methods known to one skilled in the art. An annulus is created between the casing string 114 and the production tubing 116, where any materials including, but not limited to, hydrocarbons, other fluids, or gases in the annulus may be extracted through the annulus output 106. An annulus output valve 108 may be connected to the annulus output 106 to control the flow of the materials through the annulus output 106. In the preferred embodiment, the production tubing 116 threadedly engages a fluted mandrel 118. A casing spool assembly 122 may be affixed to the top of the casing head assembly 102.

The casing spool assembly 122 may comprise a casing spool 124, an output valve 126, or series of output valves 126. The casing spool assembly 122 may be rigidly affixed to the casing head assembly 102. The casing spool assembly 122 may surround and enclose an upper portion of the fluted mandrel 118. A temporary pack-off bushing 120 may be installed on the fluted mandrel 118. Lock pins 110 may engage the temporary pack-off bushing 120 to prevent the production tubing 116 from moving within the casing string 114.

The fracking valve assembly 128 may comprise a series of fracking control valves 132, a cross tee 130, and a multi-connector fracking head 134. A pump truck, or series of pump trucks, and the associated slurry blenders creating the fracking fluid may be connected to the multi-connector fracking head 134. The fracking fluid is then forced down through the multi-connector fracking head 134, the cross tee 130, and the open fracking control valves 132, into the casing spool assembly 122, and then down through the casing head assembly 102 into the well bore to perform the fracking operations.

In a hydrocarbon production well configuration, the wellhead assembly 100 would likely comprise a casing head assembly 102, a casing spool assembly 122, and a production valve assembly that would be similar to the fracking valve assembly 128. The fracking valve assembly 128 differs from the production valve assembly by at least the multi-connector fracking head 134 and the pressure ratings of the wellhead components within the wellhead assembly 100. The typical pressure ratings of the production valve assembly may range from 1,000 up to 5,000 psi, and the components used in production may be rated appropriately based on the pressure from the well. However, during fracking operations much higher operating pressures are needed to force the fracking fluid into the wellbore and to frack the well. Pressure ratings typical of fracking operations may be 10,000 to 15,000 psi. This requires the operator of the well to change the casing head assembly 102 to higher-pressure rated components to match the pressure rating of the fracking valve assembly 128. By doing so, this ensures that the equipment is all rated for similar pressures that is likely to be seen during these fracking operations.

Figure 2:
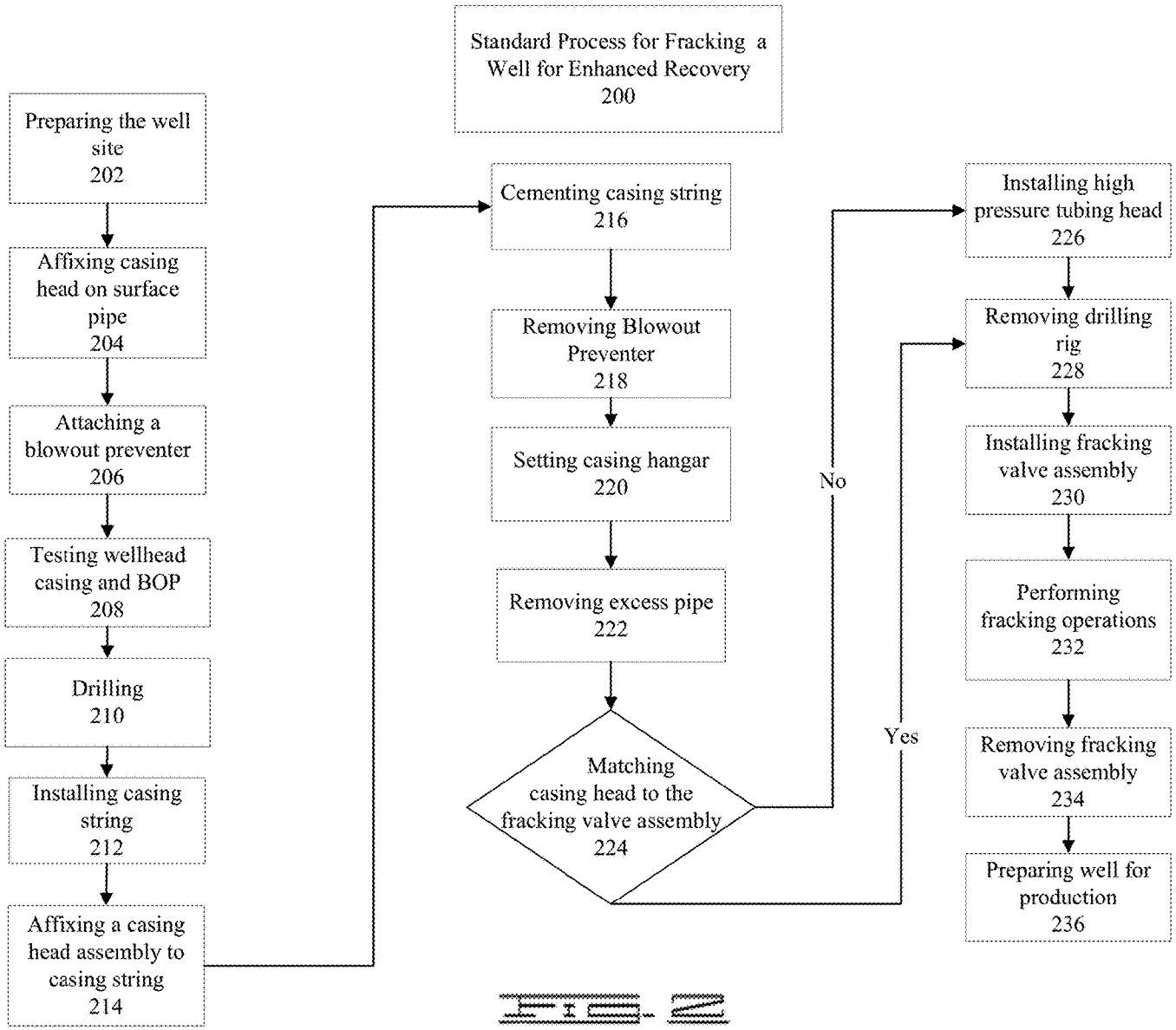
FIG. 2 is a process flow diagram illustrating the current conventional method for fracking.
Figure 1:
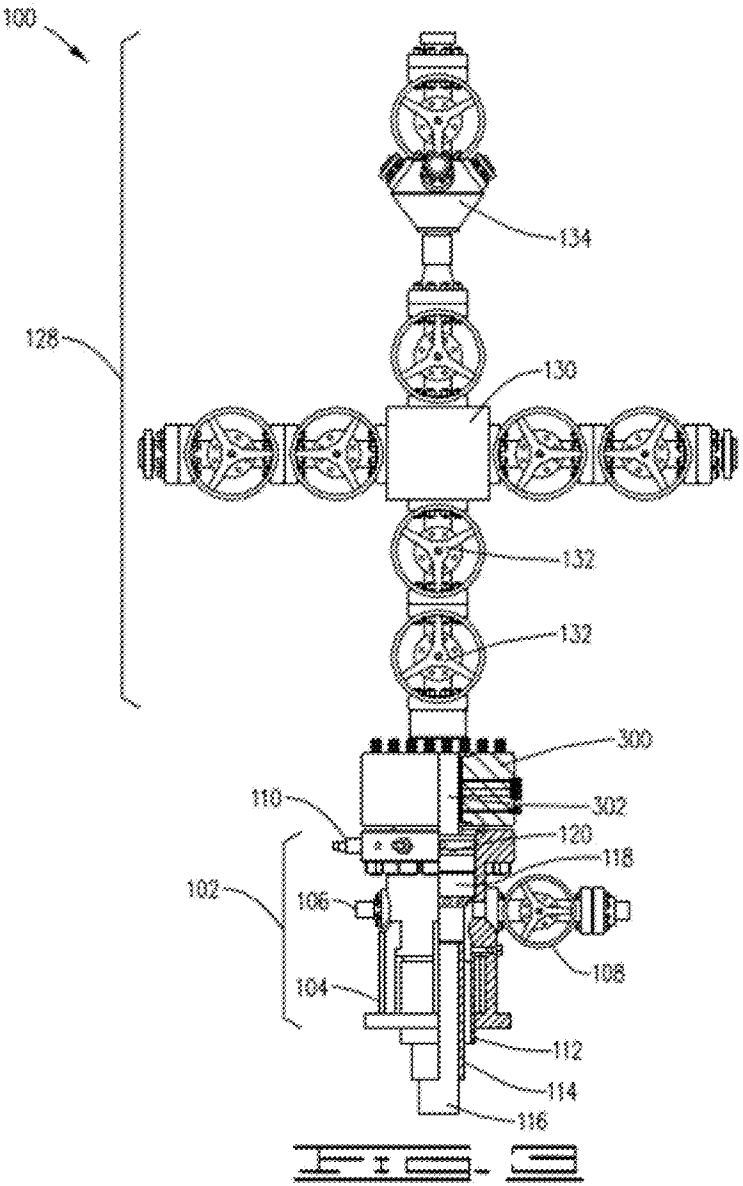

FIG. 2 illustrates a method of the standard process for fracking a well 200 for enhanced hydrocarbon recovery. In the first step 202 of the method of the standard process for fracking a well 200, an operator prepares the well site by clearing the surface area where the well is to be placed. After clearing the surface area, a drilling rig may be positioned where the operator desires to drill a well. A well bore is drilled to a desired depth, which is typically 600 to 1,000 ft, to protect the freshwater zones near the surface. After drilling the wellbore to the desired depth, the operator may insert a surface casing 112 into the wellbore. After the installation of the surface casing 112, the operator performs step 204 where the operator may affix the casing head 104 to the surface casing 112. In step 204, the casing head 104 is preferably welded to the surface casing 112. One skilled in the art may use other methods known in the oil and gas industry for affixing the casing head 104 to the surface casing 112. Once the casing head 104 has been affixed to the surface casing 112, the operator performs step 206 removably attaching a blowout preventer to the casing head assembly 102 with a plurality of fasteners that may withstand the temperatures and pressures from the oil and gas environment known to one skilled in the art. Performing the testing wellhead casing and blow preventer step 208, the operator may removably affix a cap to the top of the blowout preventer with a plurality of fasteners to create a pressure seal between the cap and the blowout preventer. After the cap has been affixed, the operator applies internal pressure to blowout preventer and casing head assembly 102 through a test port to test the seals. After the operator has verified that the seals are functioning properly, the operator may perform the next step 210, drilling a wellbore. Performing step 212, the operator may install a casing string 114 into the wellbore a desired depth. The operator may removeably affix a casing head assembly 102 to the casing string 114, completing step 214. After installing the casing string 114 in step 212 and affixing the casing head 104, in step 214, operator performs step 216 cementing the casing string 114. In step 216 the operator forces cement down through the casing string 114 and up between the casing string 114 and the formation. Cementing the casing string 114 prevents contamination, cave-ins, isolates different zones that may have differing pressures and fluids, and may seal off high pressure zones from the surface thus avoiding potential blowouts. Once the casing string 114 has been cemented in place, the operator may perform step 218 by removing the blowout preventor. After removing the blowout preventer, operator performs step 220 setting the casing hangar to support the casing string 114 in the wellbore and where the casing hanger engages the landing shoulder inside the casing head assembly 102. Preferably, the operator uses slips as the casing hangar and the operator positions the slips around the exterior of the casing string 114 to position and hold the casing string 114 in the wellbore. After completing step 220 setting the casing hangar, the operator performs step 222 by removing the excess casing string 114 rising above the wellhead assembly 100. Generally, the operator may utilize various cutting methods known to one skilled in the art to remove the excess the casing string 114. Typically, the casing string 114 may be cut with a torch, typically an oxygen-acetylene torch at the wellhead assembly 100. In completing step 224, operator may match the pressure ratings of the fracking valve assembly 128 and the casing head assembly 102 to be within the acceptable pressure differential. If the operator chooses a fracking pressure greater than at least one pressure rating of the casing head assembly 102, then the operator may perform step 226, where the operator may install a high-pressure rated tubing head to match the pressure rating of the fracking valve assembly 128 and continue to step 228. If the operator chooses a fracking pressure within the acceptable pressure differential of the casing head assembly 102, then the operator may perform step 228, where the operator may remove the drilling rig from the well site. After removing the drilling rig, the operator may removably affix a fracking valve assembly 128 to the casing head assembly 102 completing step 230. The operator may then connect fracking fluid storage tanks and pumper trucks to the multi-connector fracking head 134 of the fracking valve assembly 128. In the next step 232, performing fracking operations, the operator may use pumper trucks to force fracking fluid into the wellbore at a high pressure to enlarge the fissures to stimulate and enhance the recovery of hydrocarbons. Once the fracking operations step 232 is complete, the operator may remove the fracking valve assembly 128 completing step 234. After removing the fracking valve assembly 128, the operator may perform step 236 preparing the well for production by the operator removing the high-pressure tubing head if installed and installing a production tubing head. Once the wellhead assembly 100 is reconfigured and if no reconfiguration of the tubing head is required, the operator may removably affix a production valve assembly to complete step 236 to prepare the well for production.

FIG. 3 is a front view of a wellhead assembly 100 configured for fracking with a multi-pressure fracking adapter 300. In this configuration, the wellhead assembly 100 may comprise a casing head assembly 102, a multi-pressure fracking adapter 300, and a fracking valve assembly 128.

The casing head assembly 102 was described previously in FIG. 1 except that the casing head assembly 102 does not need to be changed to higher pressure rated components to perform fracking operations. As describe above, the production tubing 116 threadedly engages a fluted mandrel 118. However, in this configuration a multi-pressure fracking adapter 300 is positioned between the casing head assembly 102 and a fracking valve assembly 128. The multi-pressure fracking adapter 300 is removably affixed to the casing head assembly 102. Preferably, the affixation method for the multi-pressure fracking adapter 300 to the casing head assembly 102 comprise a series of threaded studs that extend from bottom of the multi-pressure fracking adapter 300 and through corresponding holes in the top of the casing head assembly 102. Fasteners may then be used to engage the threaded studs and secure the multi-pressure fracking adapter 300 to the casing head assembly 102 for safety and to prevent leaks. The number of threaded studs and fasteners may be determined by the pressures that may be observed during the fracking process.

The fluted mandrel 118 is removably affixed to the production tubing 116 contained in the well bore and sits within the casing head assembly 102. There the fluted mandrel 118 has an extended neck 302 that extends into the multi-pressure fracking adapter 300. A temporary pack-off bushing 120 is placed over the fluted mandrel extended neck 302 and inside the casing head 104 to isolate the annulus between the production tubing 116 and the casing string 114 between the casing head 104 and the multi-pressure fracking adapter 300. Lock pins 110 may engage the temporary pack-off bushing 120 to maintain the temporary pack-off bushing 120 in a desired position.

In the preferred embodiment the multi-pressure fracking adapter 300 is an integrated double-studded pack-off adapter, patent application Ser. No. 16/575,536, which is incorporated herein by reference. The fluted mandrel extended neck 302 extends above the temporary pack-off bushing 120 and into the multi-pressure fracking adapter 300. The fluted mandrel extended neck 302 may engage the top of the multi-pressure fracking adapter 300 but may not exit the multi-pressure fracking adapter 300. Within the multi-pressure fracking adapter 300 there are preferably multiple inner seals that may surround and engage the fluted mandrel extended neck 302 to provide the appropriate pressure ratings between the lower pressure wellhead assembly 100 and the higher pressure rating fracking valve assembly 128.

Attached to the top of the multi-pressure fracking adapter 300 is a fracking valve assembly 128. The fracking valve assembly 128 may be removably affixed to the multi-pressure fracking adapter 300 by a series of threaded studs that extend from the top of the multi-pressure fracking adapter 300 through corresponding holes in the bottom of the fracking valve assembly 128 flange. Fasteners may then be used to engage the threaded studs and secure the fracking valve assembly 128 to the multi-pressure fracking adapter 300 for safety and to prevent leaks. The number of threaded studs and fasteners may be determined by the pressures that may be observed during the fracking process.

In this preferred embodiment, the casing head assembly 102 may have a 5 K psi pressure rating where the fracking valve assembly 128 has a dissimilar pressure rating such as 15 K psi rated. The multi-pressure fracking adapter 300 provides the differential pressure connection between the casing head assembly 102 and a fracking valve assembly 128 so the operator can perform fracking operations safely.

Figure 4:
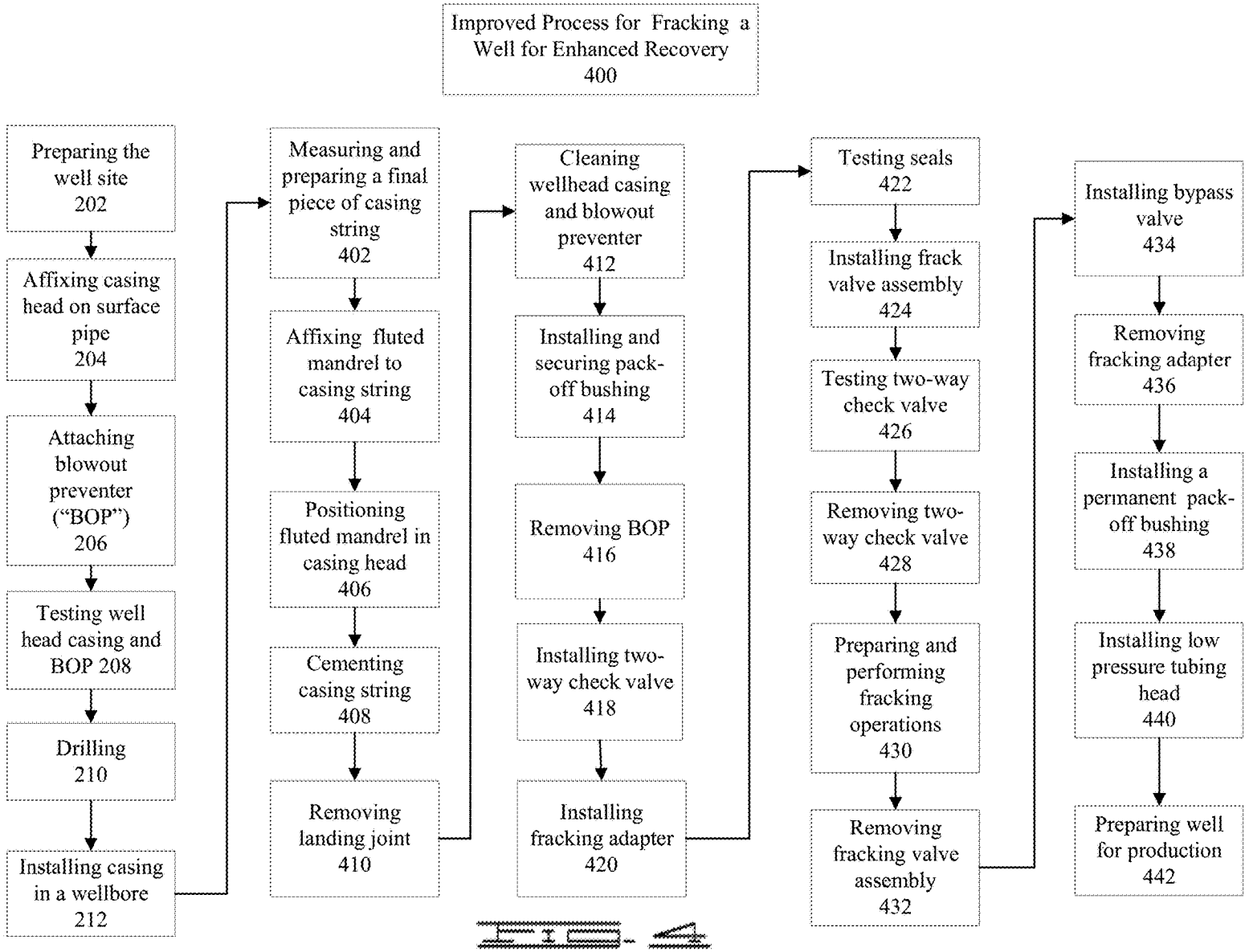
FIG. 4 is a process flow diagram illustrating the improved method fracking.

FIG. 4 illustrates a method for an improved process for fracking a well for enhanced hydrocarbon recovery 400. The method of the improved process 400 may utilize the same steps 202 through 212 to prepare wellsite and install a the casing string 114 into the wellbore as described in FIG. 2. However, the steps going forward show the improved process for fracking a well for enhanced recovery of hydrocarbons. In the preferred embodiment, the operator measures the final piece of casing string 402 to determine a specific length required. The operator cuts the final piece of casing string 114 outside the wellbore. After cutting the final piece of casing string 114 to the desired length, the operator preferably affixes the fluted mandrel 118 to casing string 404.

The fluted mandrel 118 may be positioned inside the casing head 406. Once these steps have been completed the operator cements the casing string 408 into place. When the operator has completed the cementing step 408, they may remove the landing joint 410. Afterwards the operator cleans the cement from the casing head assembly 102 and BOP 412. The temporary pack-off bushing 120 may be installed and secured 414 on the fluted mandrel extended neck 302. The BOP may be removed 416 to further prepare the well for enhanced recovery of hydrocarbons. After the pack-off bushing installation 414, the operator may install a two-way check valve 418. Once these steps have been completed, the operator may install the multi-pressure fracking adapter 420.

In the preferred embodiment the multi-pressure fracking adapter 300 is an integrated double-studded pack-off adapter, patent application Ser. No. 16/575,536. After the installation of the multi-pressure fracking adapter 420 and the multi-pressure fracking adapter 300 may be capped to seal the internal cavity where the operator test the seals 422 to verify the seals are functioning property by holding the appropriate pressure levels as required.

Once the multi-pressure fracking adapter 300 sealing functionality has been demonstrated, the operator then may install a fracking valve assembly 424. After the installation of the fracking valve assemblyl 28, the operator next may test the two-way check valve 426 for functionality. The two-way check valve may be removed 428 in preparation for fracking the well. Operator may prepare for and perform fracking operations 430 on the well. In preparing the well for fracking operations, the operator may connect the high-pressure/high volume pumps to the multi-connector fracking head 134 on the fracking wellhead assembly 100. The slurry blender receives the fracking components including, but not limited to, water, sand, chemicals, and wastewater and mixes the fracking components to create fracking fluid. The fracking fluid is forced into the wellbore by the pumping vehicles. The fracking fluid is forced into frack valve assembly 128 via the multi-connector fracking head 134 which passes through the multi-pressure fracking adapter 300 and continuing through the casing head assembly 102 into the well bore for the enhanced hydrocarbons recovery. After the fracking operations have been completed operator may remove the fracking valve assembly 432, install a bypass valve 434 and multi-pressure fracking adapter 436. The operator then may install the permanent pack off-bushing 438 by removing and replacing the temporary pack-off bushing 120 onto the fluted mandrel extended neck 302. The operator then may install a low-pressure tubing head 440 on to the casing string 114. After the installation of the low-pressure tubing head 440, the operator may prepare the well for production 442 by beginning the drill-out process.

Having thus described the invention, I claim:

1. An improved method for fracking operations of the type having the following steps:

a. preparing a selected well;
b. affixing a low-pressure casing head to a surface casing;
c. attaching a blowout preventer to the low-pressure casing head;
d. testing the low-pressure casing head and the blowout preventer for proper functionality;
e. extending a drill string into the earth to form a borehole to a first desired depth;
f. installing a casing string to a second desired depth in the borehole;
g. cementing the casing string in the second desired depth;
h. removing the blowout preventer attached to the low-pressure casing head;
i. securing within the casing string a hanger device inside the low-pressure casing head;
j. removing and replacing the low-pressure casing head with a high-pressure casing head to match the pressure rating of a frack valve assembly;
k. installing a high-pressure tubing head;
l. removing drilling rig;
m. attaching a higher pressure frack valve assembly to the top of the high-pressure tubing head, and testing at least one seal;
n. performing fracking operations on the selected well;
o. removing the frack valve assembly;
p. replacing the high-pressure tubing head with a low-pressure tubing head; and,
q. preparing the selected well for production, the improvement comprising:

A) after step f and before step g, adding the following steps:
   i) measuring the last piece of the casing string;
   ii) installing a suspension device to the last piece of the casing string;
B) after step g and before step h, adding the step of installing a temporary pack-off bushing into the casing head on the suspension device;
C) replacing steps i through l, with the following steps:
   i) affixing a two-way check valve into back-pressure valve threads in the suspension device;
   ii) attaching a fracking adapter rated up to twice the pressure rating of the casing head;

iii) pressurizing the fracking adapter to test each seal to ensure proper sealing integrity;

D) replacing step p with the following steps:

i) installing a bypass valve;

ii) installing a permanent pack-off bushing; and, iii) installing the low-pressure tubing head.

2. The method of claim 1, where a running tool is used to measure the required length of a final piece of casing string.

3. The method of claim 1, further comprising positioning the suspension device inside the casing head.

4. The method of claim 3, where the suspension device is selected from a mandrel, tubing flange, and tubing hanger.

5. The method of claim 4, where the mandrel is fluted.

6. The method of claim 1, further comprising removing a landing joint.

7. The method of claim 1, further comprising engaging locking pins to maintain the temporary pack-off bushing in a third desired position in the casing head.

8. The method of claim 1, further comprising after step m and before step n, testing the two-way check valve installed in the suspension device.

9. The method of claim 8, further comprising removing the two-way check valve.

10. The method of claim 1, further comprising removing the fracking adapter.

11. The method of claim 1, further comprising removing the temporary pack-off bushing.

* * * * *